US005850373A

United States Patent [19]

Lee

[11] Patent Number: 5,850,373

[45] Date of Patent: Dec. 15, 1998

[54] TRANSMISSION MECHANISM FOR A MAGNET-BEARING ORNAMENT

[76] Inventor: Vincent Kuo Wei Lee, No. 44, Lane 458, Sheh Chung Street, Taipei, Taiwan

[21] Appl. No.: 907,924

[22] Filed: Aug. 11, 1997

[51] Int. Cl.[6] ..... G04B 1/26; G04B 19/00; G04B 37/00

[52] U.S. Cl. ..... 368/65; 368/76; 368/223; 368/285

[58] Field of Search ..... 368/10, 62, 76, 368/77, 80, 223–228, 233, 276, 285

[56] References Cited

U.S. PATENT DOCUMENTS

| | | | |
|---|---|---|---|
| 3,938,315 | 2/1976 | ven Kemenczky | 368/94 |
| 4,228,649 | 10/1980 | Weiss | 368/93 |
| 4,945,523 | 7/1990 | Lam | 368/285 |
| 5,272,681 | 12/1993 | Lee | 368/62 |

*Primary Examiner*—Vit W. Miska

*Attorney, Agent, or Firm*—David E. Dougherty, Esquire

[57] ABSTRACT

A transmission mechanism for a magnet-bearing ornament, in which a clock main spring barrel serves to provide power required by the ornament to show a dynamic scene. The clock main spring barrel has a second wheel to replace a conventional second hand. The second wheel has a large number of teeth provided along its circumferential surface and meshes with a small driven gear to cause the latter to rotate at a high speed. The small driven gear may then cause a magnet-bearing member to coaxially rotate with it via a rotating shaft of the gear connected to the magnet-bearing member. Alternatively, the small driven gear is provided with a major rotational disc having magnets attached thereto. When the small driven gear rotates, the major rotational disc rotates synchronously to magnetically rotate the magnet-bearing member behind a background board of the ornament disposed between the clock main spring barrel and a front showing space. The rotated magnet-bearing member shall cause some magnetically inducible articles in the showing space to move in changeful manners.

3 Claims, 7 Drawing Sheets

TRANSMISSION MECHANISM FOR A MAGNET-BEARING ORNAMENT

BACKGROUND OF THE INVENTION

The present invention relates to a transmission mechanism for a magnet-bearing ornament, and more particularly to a transmission mechanism which uses a second wheel included in a clock main spring barrel as a power source. The second wheel has large numbers of circumferential teeth to mesh with a small driven gear, so that the small gear is caused to rotate at a high speed and bring a magnet-bearing member connected to a rotating shaft of the small gear to coaxially rotate. Alternatively, the small driven gear may indirectly rotate the magnet-bearing member by means of magnetic attraction between the gear and the member. The rotated magnet-bearing member shall then cause magnetically inducible articles in a showing space of the ornament to move in changeful manners, showing a dynamic scene on the ornament.

Magnet-bearing oranments providing a dynamic scene are now very popular in the market. Such ornaments usually include a magnet-bearing member which rotates or moves in other manners to cause some magnetically inducible articles in the ornaments to move in changeful manners, and therefore show a dynamic scene in the ornaments. Most of these ornaments use batteries and a motor to rotate the magnet-bearing member. The batteries have to be replaced from time to time due to a high power consumption of the ornaments. To save the power consumption, the ornaments are normally turned off. This prevents the ornaments from providing the dynamic scene for a long and continued time period. The same drawbacks existed in the conventional spring-actuated dynamic ornaments are found in these battery or motor powered ornaments. U.S. Pat. No. 5,272,681 titled "Dynamic Fluid Clock" granted to the inventor discloses an ornament which employs a second hand shaft of the clock as the only source to provide a transmission force. In the above US patent, the second hand is so designed that it is a magnet-bearing disc serving as a magnetic inductor. The second magnetic inductor causes magnetically inducible articles in a fluid-filled container on the ornament to move along with 1. the magnetic inductor every one second. At least following advantages are found in this type of power source employing a clock main spring barrel:
1. The clock main spring barrel consumes only a very low power and therefore the same batteries used on the present invention can provide longer service life than on the motor-actuated ornaments. The batteries need not to be replaced frequently.
2. The clock main spring barrel can be used for time indication while its second hand shaft can be used as a power source of the dynamic fluid ornament, giving the ornament a combined function and an added value.
3. Due to its low power-consumption, the ornament actuated with a clock main spring barrel can be used for a prolonged time period without the necessity of frequent replacement of batteries and/or switching on and off the ornament. This enables the ornament to be displayed at any place at any time.

SUMMARY OF THE INVENTION

A primary object of the present invention is to provide a transmission mechanism for a magnet-bearing ornament, which enables the magnet-bearing member in the ornament to rotate or move in other manners at a higher speed, so as to show a fully dynamic and more interesting and attractive scene on the ornament.

To achieve the above object, the transmission mechanism according to the present invention mainly includes a clock main spring barrel as a power source and a toothed second wheel changed from a conventional second hand. The second wheel is provided with a large number of circumferential teeth to mesh with a small driven gear, so that the small driven gear is brought by the second wheel to rotate at a higher speed. The small driven gear may in turn rotate a magnet-bearing member either via a gear shaft connected to the magnet-bearing member or by magnetic attraction. When the magnet-bearing member is rotated by the small driven gear at high speed, it causes some magnetically inducible articles in a showing space of the ornament to be magnetically induced and to move in more changeful manners.

DETAILED DESCRIPTION OF THE PREFERRED EMBODIMENTS

Figure 1:
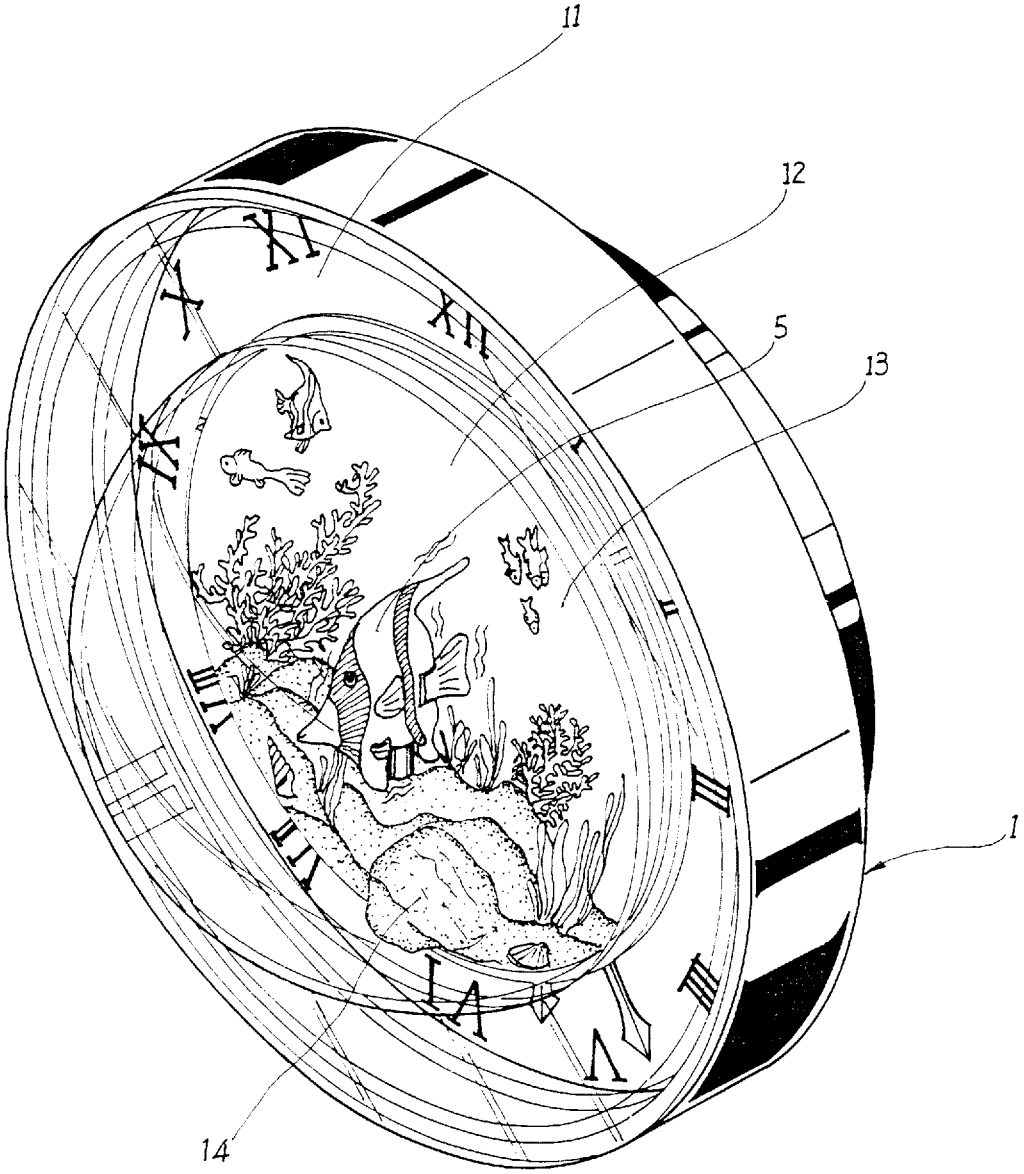
FIG. 1 is a perspective of an ornament using a first embodiment of the present invention.
Figure 2:
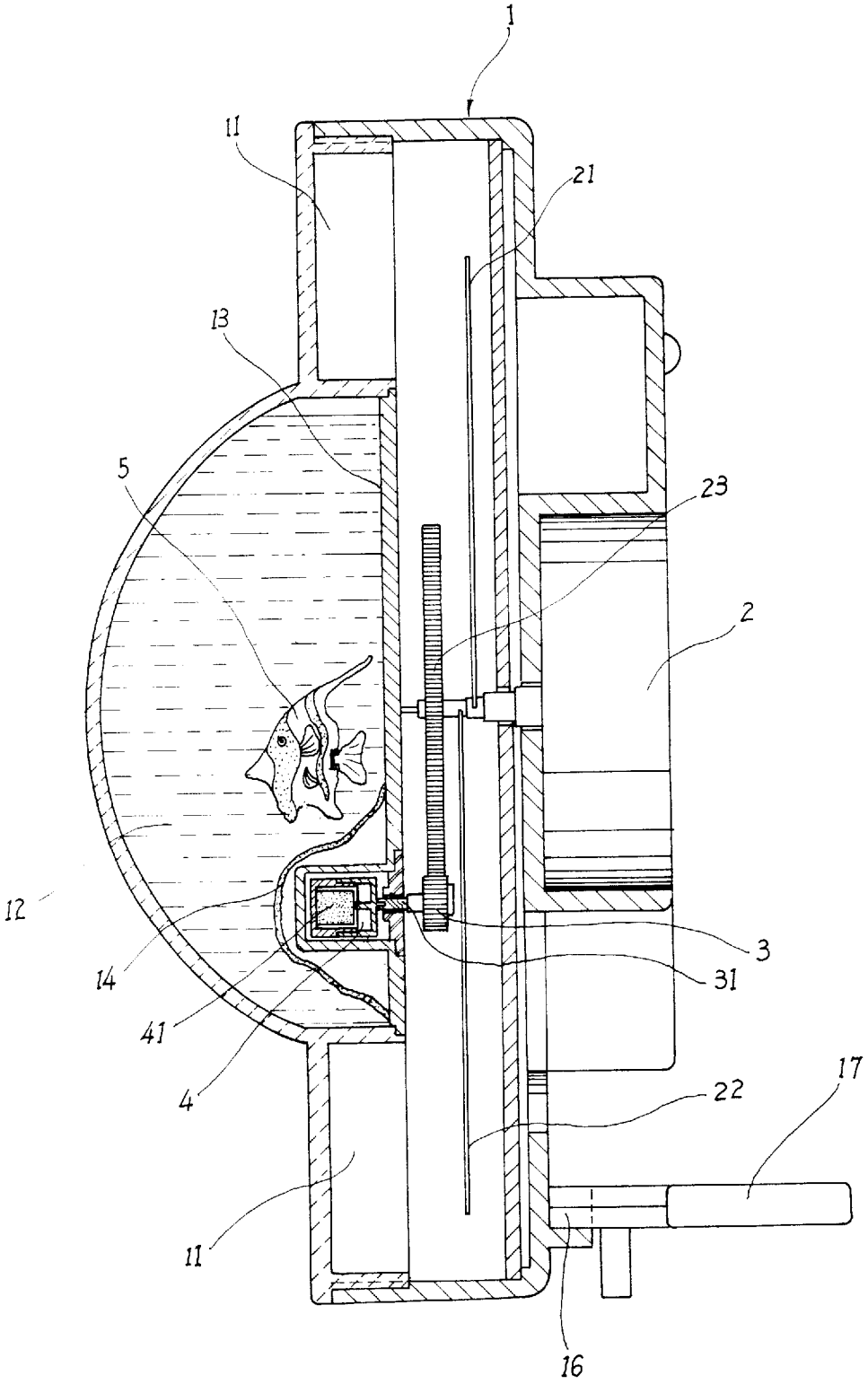
FIG. 2 is a side sectional view of the ornament of FIG. 1.

Please refer to FIGS. 1 and 2 in which a magnet-bearing ornament 1 with a transmission mechanism according to a first embodiment of the present invention is shown. The magnet-bearing ornament 1 includes a clock main spring barrel 2. An hour hand 21 and a minute hand 22 are provided in front of the main spring barrel 2 and respectively have a predetermined length, so that their free ends locate in an outer annular area 11 of a front surface of the ornament 1 and can be seen from outside the ornament 1. A second wheel 23 is provided to replace a conventional second hand driven by a second shaft connected to the main spring barrel 2. The second wheel 23 has a dimension and material that are properly selected without affecting a given torque force of the second shaft of the main spring barrel 2. The second wheel 23 is formed of a considerably large number of teeth, so that it may drive a small driven gear 3 meshed with it to rotate at a high speed. The small driven gear 3 is rotatably mounted on a supporting member fixed to the ornament 1, so that a rotating shaft 31 of the small driven gear 3 is connected to and brings a magnet-bearing member 4 to coaxially rotate with the small driven gear 3 at the same time. The magnet-bearing member 4 can be of any shape and bears one or more pieces of magnets 41. Numbers of the magnets 41 and arrangements of magnetic poles are not particularly limited. That is, the ornament 1 can be differently designed depending on any desired changes in the magnetic pole positions. When the magnet-bearing member 4 rotates, it causes changes in the position of the magnetic poles. A main purpose to cause such changes in the magnetic pole positions is to produce changed magnetic fields within a magnetic induction effective space. Whereby, one or more articles 5 that can be magnetically induced by the magnets 41 inside the magnet-bearing member 4 may be induced to move and provide some anticipated dynamic and interesting decorative scenes on the ornament 1.

To achieve better magnetic induction effect, the ornament 1 is provided at a front surface with a transparent and suitably sized showcase to define a showing space 12 therein for accommodation of the magnetically inducible articles 5 and other decorative items. The showing space 12 substantially surrounds the magnet-bearing member 4, allowing the magnetically inducible articles 5 in the showing space 12 to dynamically move due to magnetic induction by the magnets 41 in the magnet-bearing member 4. The showing space 12 is not necessarily a closed space. As shown in FIGS. 1 and 2, liquid can be filled in the showing space 12. And, articles 5 can be designed to look like some fish. Changing magnetic fields cause the fish-shaped articles 5 to "swim" in water, that is, in the liquid filled in the showing space 12.

The small driven gear 3 is not necessarily mounted to a fixed position on the ornament 1. The gear 3 can be located at any point meshing with a toothed circumferential surface of the second wheel 23, depending on the actual need in design. Thus, the magnet-bearing member 4 may also have different positions on the ornament 1. However, to achieve better magnetic induction effect between the articles 5 and the magnet-bearing member 4, the magnet-bearing member 4 is preferably located at a position forward projecting into the showing space 12, as shown in FIG. 2. To match with the shape designed for the articles 5, suitable decorative items and a background board 13 can be provided in the showing space 12. The background board 13 may be decorated or printed with different patterns or pictures and can be partially deformed to forward project into the showing space 12 to match with the forward projected magnet-bearing member 4. Alternatively, a separated decorative panel 14 can be provided in the showing space 12 to separate the protruded magnet-bearing member 4 from the liquid-filled showing space 12. FIGS. 1 and 2 illustrate the showing space 12 with such separated decorative panel 14. In either case, the liquid in the showing space 12 can be prevented from leaking out of the showing space 13 via the rotating shaft 31 connecting the magnet-bearing member 4 to the small driven gear 3.

Figure 3:
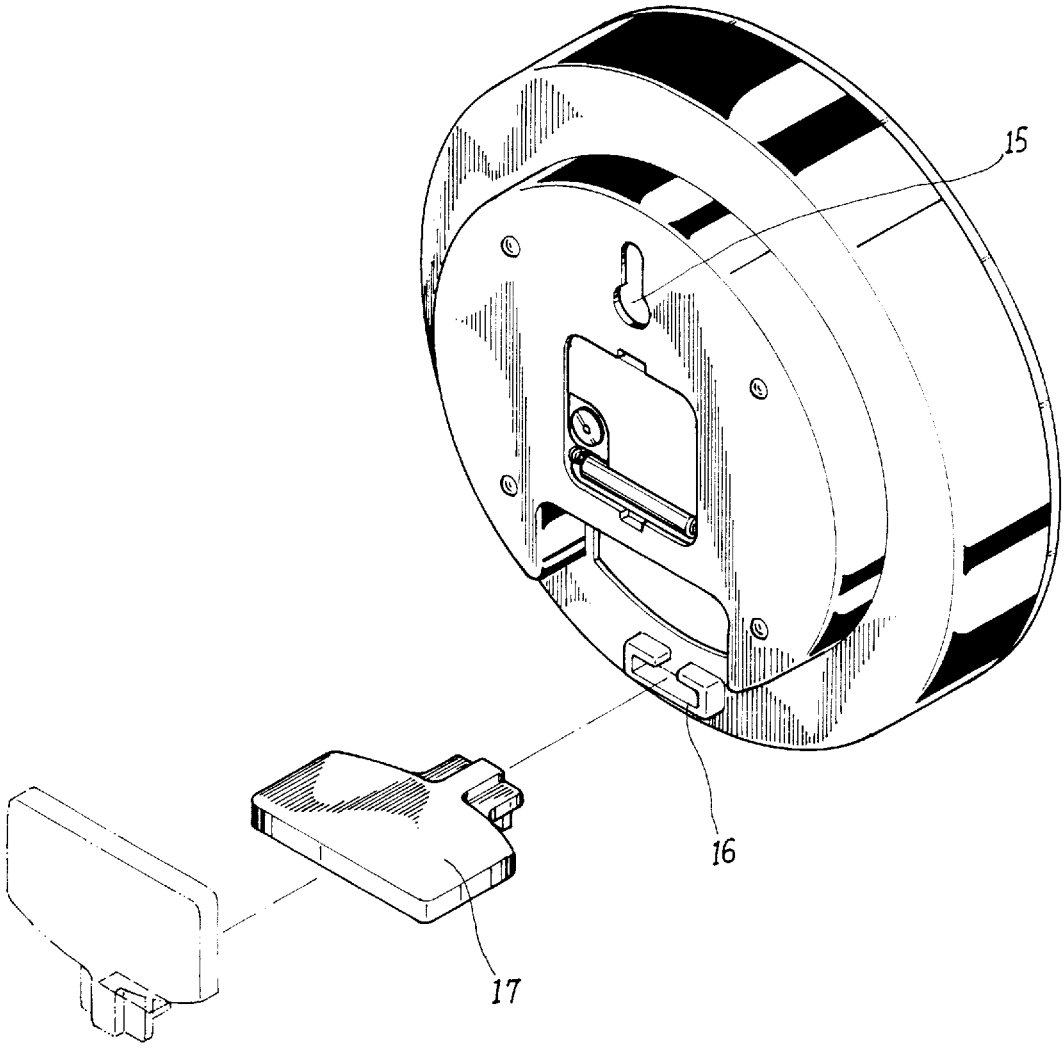
FIG. 3 is a perspective back view of the ornament of FIG. 1.

The ornament 1 as shown in FIGS. 1 and 2 may be hung on a wall surface or placed on a table or desk top. Or, as shown in FIG. 3, the ornament 1 can be provided at a back side with a hanging hole 15 and at a bottom with a bracket 16 and a matching supporting member 17 pivotally inserted in the bracket 16. When the supporting member 17 is inserted in the bracket 16 in a horizontal position, it serves as a movable support to allow the ornament 1 to incline backward but stably locate on the table or desk top. When the ornament 1 is in this backward inclined position, time indication by the hour hand and the minute hand at the outer annular area of the front surface of the ornament 1 can be clearly seen, while a dynamic scene provided in the showing space 12, that is, a central portion of the front surface of the ornament 1, allows the ornament 1 to provide a unique display effect which has never been found in other products available in the market.

Figure 4:
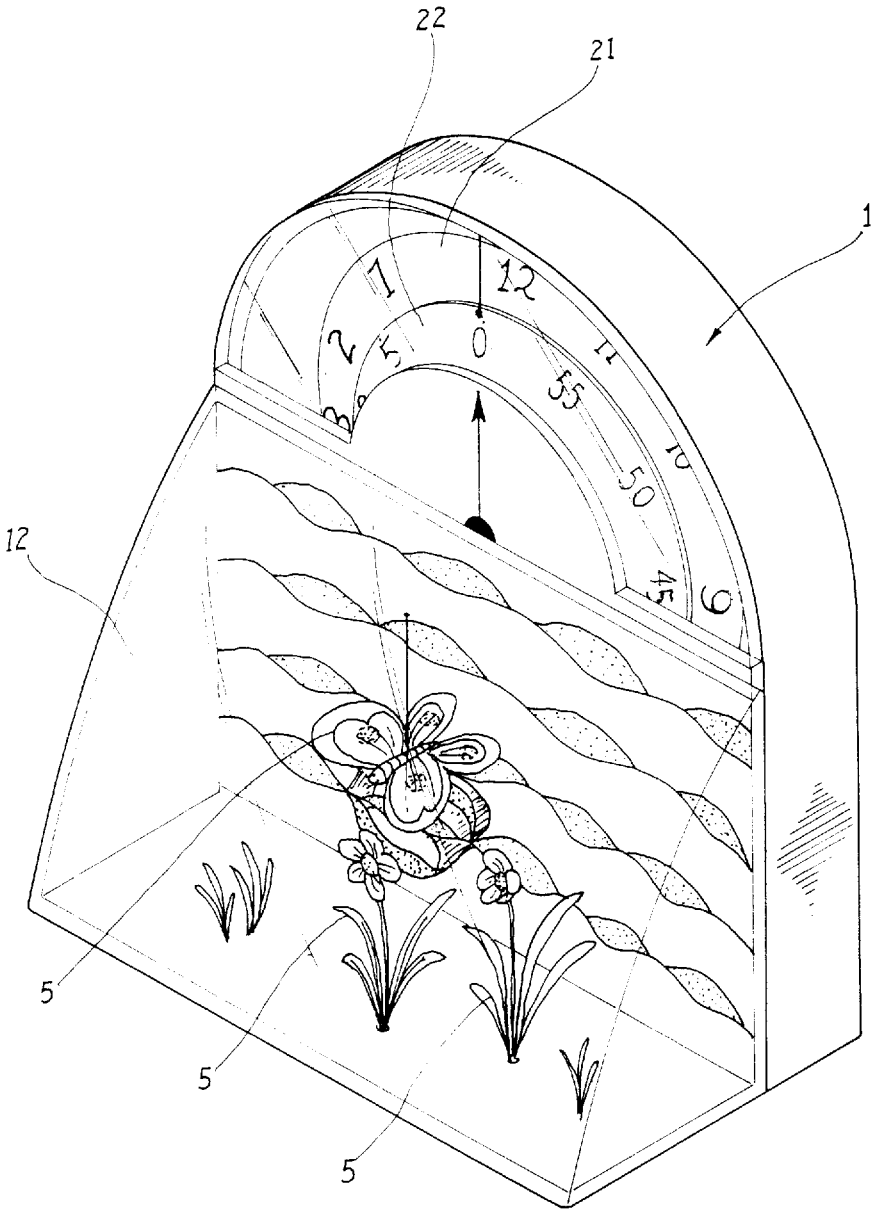
FIG. 4 is a perspective of another ornament using a second embodiment of the present invention.
Figure 5:
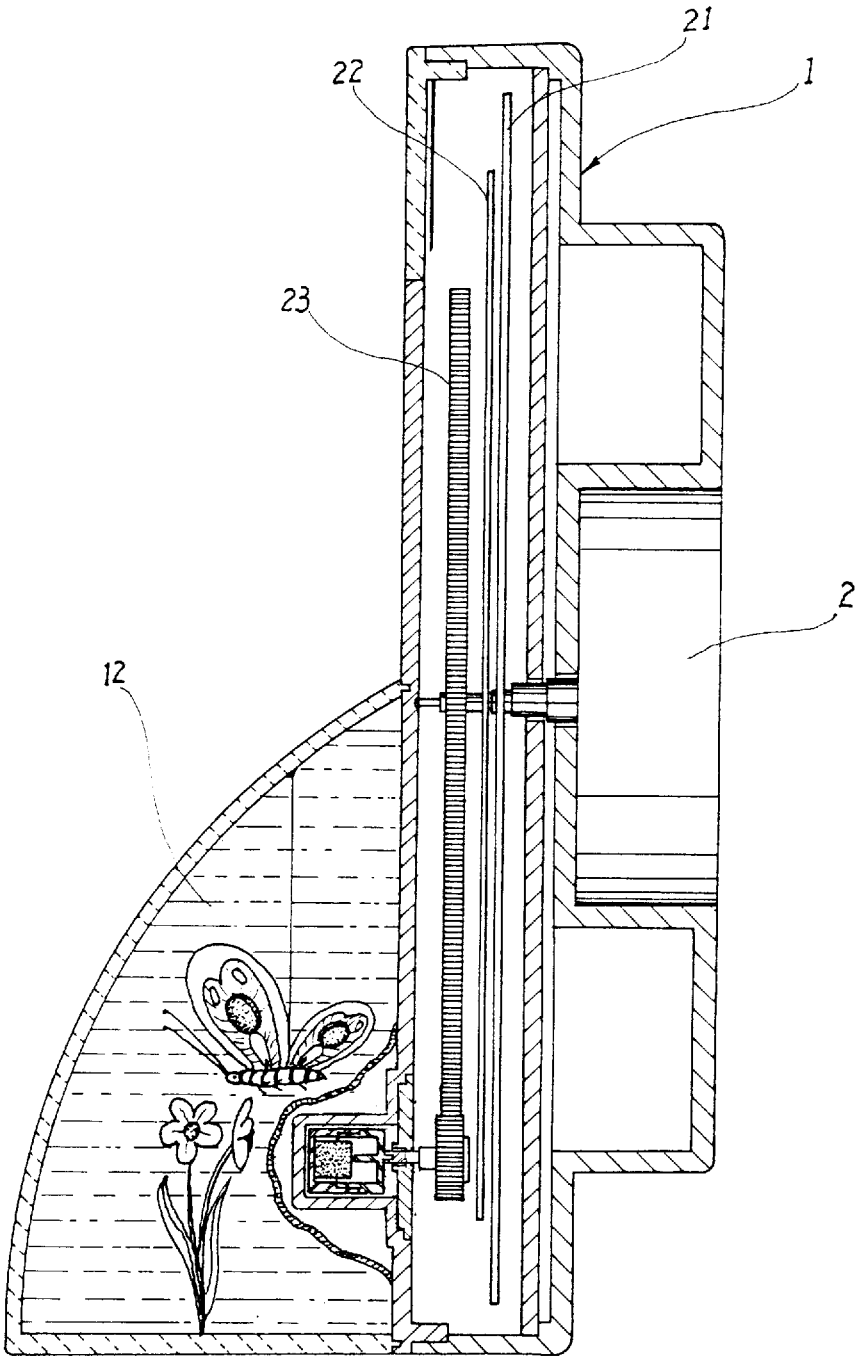
FIG. 5 is a side sectional view of the ornament of FIG. 4.

FIGS. 4 and 5 illustrate another differently designed ornament 1 using a second embodiment of the transmission mechanism of the present invention. In this embodiment, the clock main spring barrel 2 allows the time indication in a different manner. The hour hand 21 and the minute hand 22 in the first embodiment of the present invention are replaced by two dials 21, 22 respectively provided at their front surfaces with scales or figures representing hours and minutes. A pointer is fixedly provided near a top front of the ornament 1 to indicate the time shown by the two dials 21 and 22. To match with this different time indication manner, the showing space 12 in this embodiment is located at a lower front portion of the ornament 1, while the second wheel 23, the small driven gear 3, and magnet-bearing member 4, and the magnetically inducible articles 5 are arranged by similar technical means. This second embodiment of the present invention is different from the first embodiment in the different arrangements of components in the ornament 1. For example, the showing space 12 is provided thereinside with a scene of a garden and the articles 5 are butterflies hanging from a top of the showing space 12 by means of fine strings, as well as some other soft plants. The rotation of the magnet-bearing member 4 by the transmission mechanism of the present invention behind the showing space 12 causes changing magnetic fields in the showing space 12 and magnetically induces the butterflies and plants to swing or sway, giving a dynamic and interesting display effect.

In the embodiments shown by FIGS. 1 to 5, the small driven gear 3 has a rotating shaft 31 which directly extends into the magnet-bearing member 4 to bring the latter to coaxially rotate with the small driven gear 3. In a third embodiment of the present invention, the magnet-bearing member 4 is indirectly brought to rotate while the same dynamic display effect can be achieved.

Since the third embodiment of the present invention involves only improvements to a small part of the transmission mechanism, the appearance of the ornament 1 is not affected and can be substantially the same as that shown in FIGS. 1 to 5. An overall structure of the ornament 1 is also the same in all these embodiments.

The ornament 1 with the third embodiment of the transmission mechanism of the present invention mainly includes a main body 1, an outer annular area 11, a showing space 12, a background board 13, a decorative panel 14, a clock main spring barrel 2, an hour hand 21, a minute hand 22, a second wheel 23, a small driven gear 3, a magnet-bearing member 4, magnets 41, and magnetically inducible articles 5. Unlike the small driven gear 3 in the previous two embodiments, which has a rotating shaft 31 mounted on a supporting member, such as the background board 13 of the ornament 1, to extend into and connect with the magnet-bearing member 4, so as to bring the member 4 to coaxially rotate with the small driven gear 3, the small driven gear 3 in this third embodiment does not have a rotating shaft but is provided at one side close to the background board 13 with a fixedly attached major rotational disc 32, so that the major rotational disc 32 and the small driven gear 3 rotate synchronously. The major rotational disc 32 has an adequate diameter and has predetermined numbers of magnets 33 being properly arranged on a surface of the disc 32 that faces the magnet-bearing member 4. The magnet-bearing member 4 again bears predetermined numbers of magnets 41 thereinside. A secondary rotational disc 42 is provided on the magnet-bearing member 4 near an end thereof close to the background board 13. The secondary rotational disc 42 is provided on a surface that faces the background board 13 with magnets 43 in numbers and positions corresponding to that of the magnets 33, so that magnets 33 and 43 attract one another. Whereby, when the major rotational disc 32 rotates, it may magnetically rotate the secondary rotational disc 42 at the other side of the background board 13 to achieve the same transmission function as that would achieved via the rotating shaft 31 of the small driven gear 3. To prevent the secondary rotational disc 42 from being magnetically attached to the background board 13 and therefore forming increased frictionally contacting areas with the background board 13, a projected shaft 44 having a smoothly rounded free end is additionally provided to a center of the secondary rotational disc 42, so that the secondary rotational disc 42 rotates with the smoothly rounded free end of the projected shaft 44 pushing against the background board 13, permitting the whole magnet-bearing member 4 to rotate in a more smooth manner.

The indirect transmission of components inside the ornament 1 by means of magnetic attraction is different from the direct transmission via coaxial rotating force in at least following aspects:

1. The magnetic force of the magnets 41 carried by the magnet-bearing member 4 has direct relation with the motion of the magnetically inducible articles. However, when bigger and heavier magnets 41 are required to achieve desired dynamic display effect, the small driven gear 3 used to directly rotate the magnet-bearing member 4 via the rotating shaft 31 might encounter with a condition of insufficient torque force which will also adversely effect the accuracy of hour and minute hands controlled by the clock main spring barrel 2. On the other hand, when the indirect transmission manner by means of magnetic attraction is used to rotate the magnet-bearing member 4, since the background board 13 completely separates the liquid-filled showing space 12 from the rest portion of the ornament 1, a space for accommodating the magnet-bearing member 4 between the background board 13 and the decorative panel 14 and even an additional housing 131 attached to the background board 13 for covering the magnet-bearing member 4 is not necessarily to be watertight. It is even desirable to provide in this-space with liquid or bubbles so that a buoyancy of the liquid and bubbles makes the whole magnet-bearing member 4 lighter for the major rotational disc 32 to magnetically rotate the member 4 more easily.
2. Since the housing 131 and the decorative panel 14 are not necessarily to be a watertight design, the problem of providing any packing around the rotating shaft 31 does not exist. Moreover, since the magnetic attraction between the major and the secondary rotational discs 32, 42 shall cause the magnet-bearing member 4 to automatically return to its position behind the background board 13 corresponding to the small driven gear 3, the housing 131 or the decorative panel 14 for covering and limiting the member 4 in place behind the background board 13 needs not to be very accurately manufactured. A tolerance is allowed between joints of these components.

Figure 6:
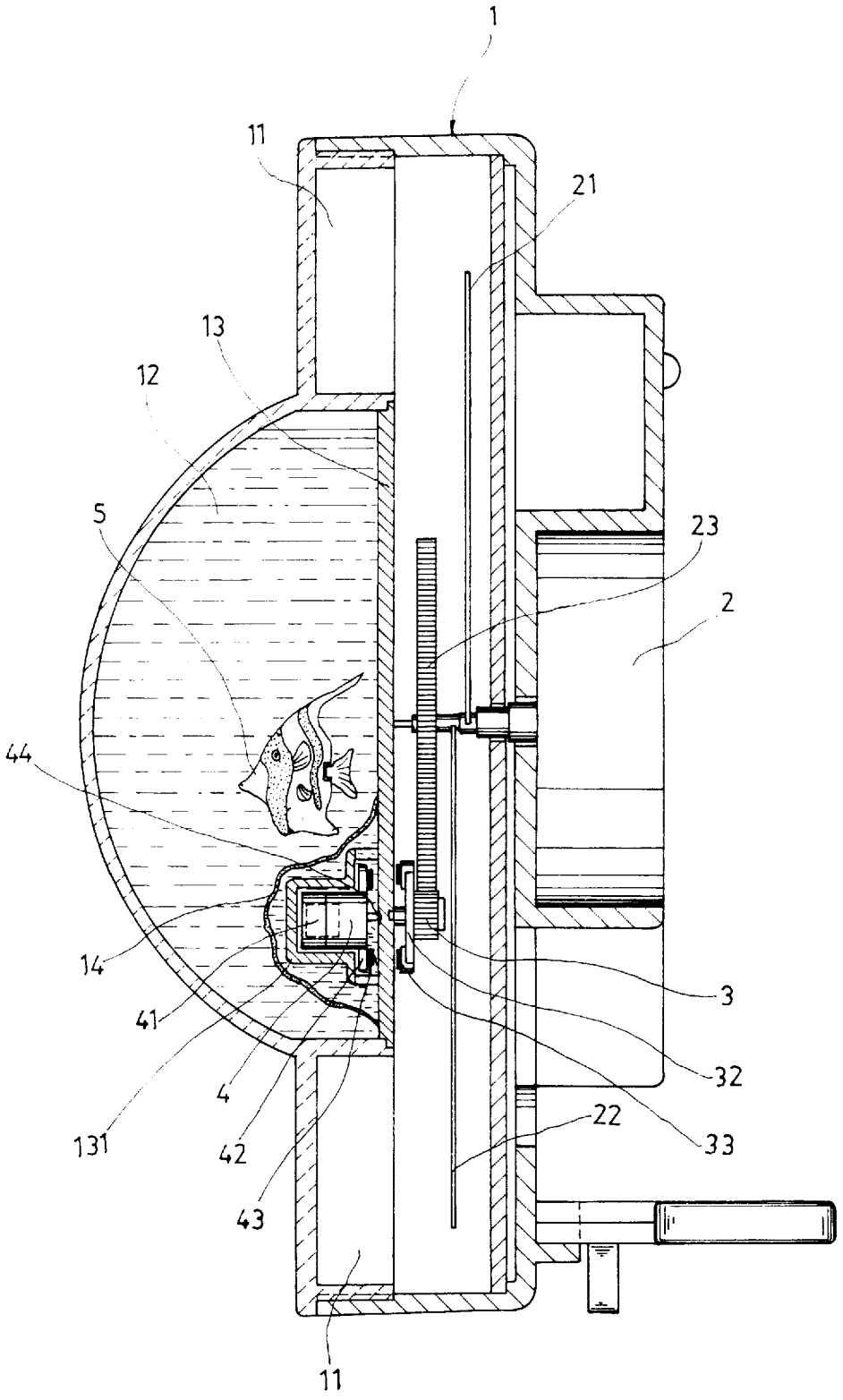
FIG. 6 is a side sectional view of an ornament similar to that in FIG. 1 but using a third embodiment of the present invention.
Figure 7:
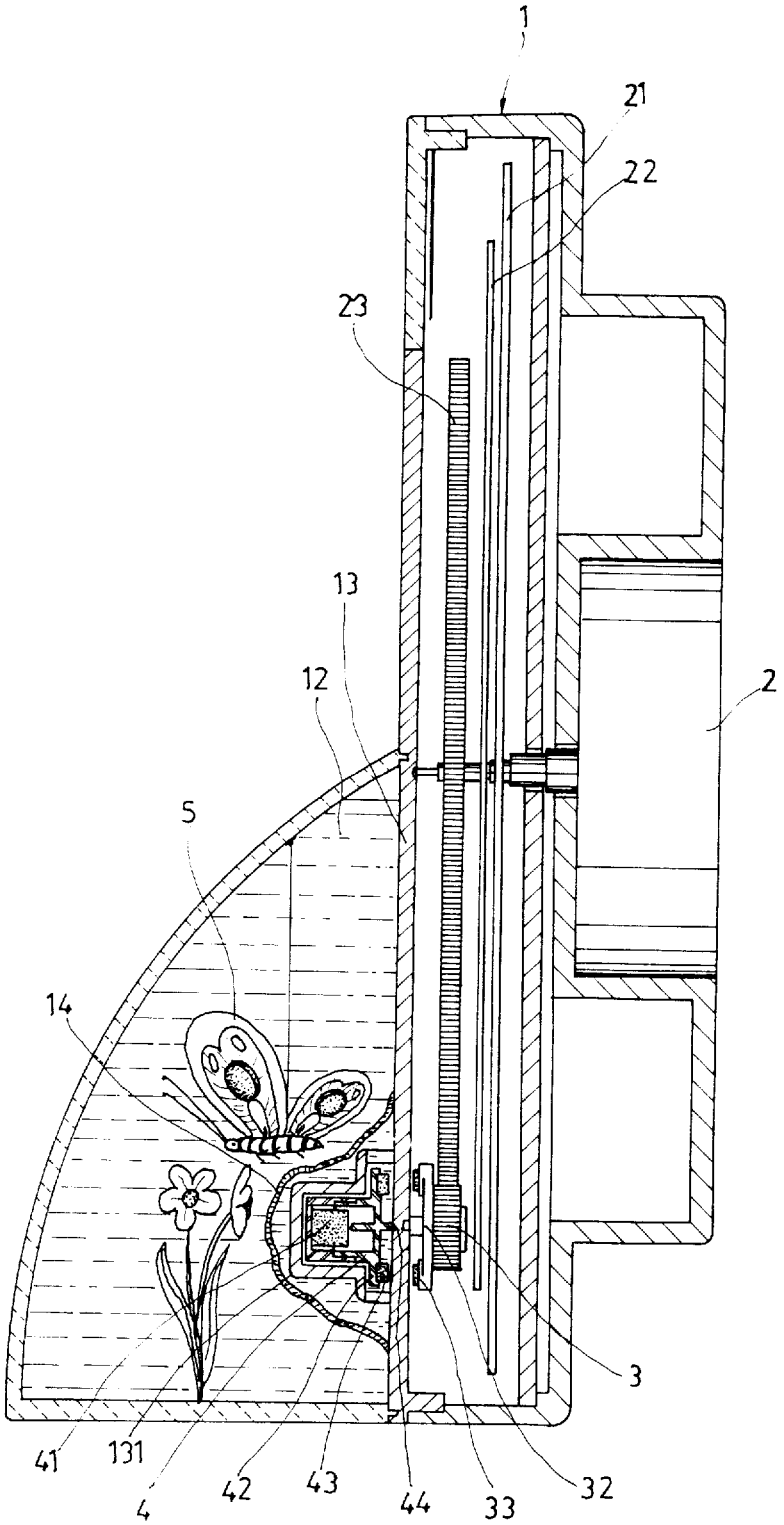
FIG. 7 is a side sectional view of the ornament of FIG. 5 but with the third embodiment of the present invention.

Ornament 1 illustrated in FIG. 7 is similar to that of FIG. 5 but employing the indirect transmission by magnetic attraction as shown in FIG. 6. That is, the small driven gear 3 no longer has a rotating shaft 31 and is provided with a major rotational disc 32 to magnetically rotate a secondary rotational disc 42 provided about the magnet-bearing member 4 behind the background board 13.

From experiments conducted on the magnet-bearing ornament 1 having transmission mechanism according to the present invention, the second shaft of the clock main spring barrel is proven to provide sufficient and adequate torque force and batteries are proven to have prolonged life to provide power to the ornament 1.

What is claimed is:

1. A transmission mechanism for a magnet-bearing ornament, comprising a clock main spring barrel serving as a power source, said clock main spring barrel being provided with an hour hand and a minute hand for time indication, and a second wheel replacing a conventional second hand, said second wheel being provided on a circumferential surface with considerably large numbers of teeth so as to drive a small driven gear meshing with said second wheel to rotate at a speed much higher than that of said second wheel, said small driven gear in turn causing a magnet-bearing member to rotate behind a background board which separates said clock main spring barrel from a front showing space of said ornament, and said magnet-bearing member further causing one or more magnetically inducible articles in said showing space to move in changeful manners.

2. A transmission mechanism for a magnet-bearing ornament as claimed in claim 1, wherein said small driven gear directly rotates said magnet-bearing member via a rotating shaft of said small driven gear extending through said background board to connect to said magnet-bearing member.

3. A transmission mechanism for a magnet-bearing ornament as claimed in claim 1, wherein said small driven gear is provided at one side close to said background board with a major rotational disc having a plurality of magnets attached thereto, and said magnet-bearing member being provided at one end close to said background board with a secondary rotational disc corresponding to said major rotational disc, whereby when said major rotational disc rotates along with said small driven gear, said major rotational disc causes said secondary rotational disc, and accordingly, said magnet-bearing member to rotate behind said background board due to a magnetic attraction between said major and said secondary rotational discs.

* * * * *